United States Patent [19]

Sautton

[11] 4,004,507

[45] Jan. 25, 1977

[54] ENVELOPE INDEXING HEAD AND AN INDEXING APPARATUS EQUIPPED WITH SAME

[75] Inventor: Guy Sautton, Saint Denis, France

[73] Assignee: Hotchkiss Brandt Sogeme, Paris, France

[22] Filed: May 24, 1976

[21] Appl. No.: 688,986

Related U.S. Application Data

[63] Continuation of Ser. No. 509,532, Sept. 26, 1974, abandoned.

[30] Foreign Application Priority Data

Oct. 2, 1973 France ..... 73.35209

[52] U.S. Cl. ..... 101/93.42

[51] Int. Cl.[2] ..... B41J 9/12

[58] Field of Search ..... 40/122; 101/71, 91, 101/93.04, 93.11, 93.37, 93.41, 93.42, 93.43, 93.48; 197/1 R

[56] References Cited

UNITED STATES PATENTS

| | | | |
|---|---|---|---|
| 761,210 | 5/1904 | Cottrill | 101/93.41 |
| 2,338,173 | 1/1944 | Furman | 101/93.43 |
| 2,869,455 | 1/1959 | Knutsen | 197/1 R X |
| 2,919,171 | 12/1959 | Epstein | 197/1 R X |
| 3,209,681 | 10/1965 | Sanborn | 197/1 R X |
| 3,217,640 | 11/1965 | Bradshaw | 197/1 R X |
| 3,312,163 | 4/1967 | Muyshondt | 197/1 R X |
| 3,444,975 | 5/1969 | Simshauser | 101/93.04 X |
| 3,605,611 | 9/1971 | Konkel | 101/93.48 X |
| 3,606,837 | 9/1971 | Waibel | 101/316 |
| 3,734,011 | 5/1973 | Williams | 101/91 |
| 3,738,263 | 6/1973 | Combs | 101/93.42 |
| 3,769,906 | 11/1973 | Martin | 101/91 |
| 3,797,629 | 3/1974 | Moser | 101/93.04 X |

*Primary Examiner*—Harland S. Skogquist
*Attorney, Agent, or Firm*—Edwin E. Greigg

[57] ABSTRACT

The present invention relates to an indexing head designed to print on postal envelopes indexing marks translating information written on the envelopes so as to enable the same to be read by an automatic sorting machine.

The indexing code comprises printing 20 marks with actinic ink in a line comprising 30 positions. The head comprises as many reciprocal elements as there are positions, each reciprocal element being displaced by an electromagnet associated therewith. The printing operation is effected by selectively exciting the electromagnets corresponding to positions where the marks are to be printed.

The indexing head is designed for use in indexing apparatus preceding automatic sorting of mail.

6 Claims, 7 Drawing Figures

ENVELOPE INDEXING HEAD AND AN INDEXING APPARATUS EQUIPPED WITH SAME

This is a continuation of application Ser. No. 509,532, filed Sept. 26, 1974.

BACKGROUND OF THE INVENTION

The present invention relates to an envelope indexing head and to an indexing apparatus which is equipped with the same.

Automation of postal sorting operations has necessitated the prior indexing of envelopes, that is, the printing of marks on the envelopes which correspond to the address elements written in clear form. These marks must then be automatically read by the sorting machines.

At the present time, these marks are provided by printing in actinic ink a number of vertical strokes along a horizontal line which is about 50 mm in length and known as the indexing line. These strokes are about 4 mm in height, 0.4 mm in width and their "pitch" is about 1.66 mm. In the current indexing machine code, there are 30 vertical stroke places. The presence or absence of strokes, in other words, their number and distribution along the indexing line is characteristic of a predetermined indexing according to the code employed. It is this sequence of strokes along the indexing line which is read by the automatic sorting machine. This reading requires that the indexing line is located with some precision both with respect to the bottom of the envelope and with respect to its front portion.

The indexing operations comprise reading the address, translating the same into a control language, the transmitting of the control signals thus determined to the indexing head together with the signal to print.

The indexing head is the device which prints the indexing strokes on the envelope when it receives the control signals characteristic of the indexing marks to be printed.

The processing of these control signals as a result of reading the address is effected either automatically or manually by an operator. In the latter case, the operator taps on a keyboard the information read on the address and a logic device which is not part of the present invention translates the information tapped on the keyboard into a program for supplying the various circuits of the indexing head according to the machine code employed. The printing operation is triggered by the transmission of an execution signal by the logic device which supplies the various circuits of the indexing head in accordance with the program which it has set up.

OBJECTS OF THE INVENTION

According to the invention, the indexing head comprises:

a plurality of reciprocal elements mounted in parallel and in a longitudinally displaceable manner in a receptacle, the number of these reciprocal elements being equal to the number of strokes capable of being printed during indexing operations, each reciprocal element being mechanically connected to an electromagnet which is associated therewith, each electromagnet being excited by a specific winding by means of which each reciprocal element is longitudinally displaced each time the corresponding winding is excited, one end of each reciprocal element being situated on a line constituting the indexing line and possessing the dimensions in terms of height and width of the indexing strokes;

an assembly for receiving and holding immobile the envelope to be indexed for the duration of the printing process, this assembly occupying with respect to the indexing line a predetermined position with respect to the bottom of the envelope and with respect to its forward section.

The semi-simultaneous printing of all the indexing marks on the stationary envelope by the reciprocal elements, the position of which is well defined, guarantees the precision of the positions of the indexing marks but it makes it difficult to position the electromagnets associated with each reciprocal element, in view of the fact that each of these magnets must be able to operate independently of the adjacent electromagnets without magnetically influencing the same.

To obtain a satisfactory arrangement of the electromagnets, the latter are distributed in four groups situated respectively on the front and rear, upper and lower parts of the reciprocal elements such that two adjacent electromagnets are connected to the reciprocal elements separated by three spaces.

The indexing head according to the invention is characterized in that the mechanical connection points between the reciprocal element and the electromagnet are displaced from one reciprocal element to another — alternately to the front, to the rear, above and below, such that the electromagnets are distributed in four groups consisting of the upper group, the lower group, the front group and the rear group. As a result, an electromagnet is connected to the fourth element after the element is connected to the adjacent electromagnet.

An indexing head of this type may be used on its own: An operator reads the address on an envelope which appears and presses the corresponding keys of the indexing keyboard. The envelope is thereafter manually placed in the indexing position. When the envelope is placed in this position, it triggers the printing signal. After printing, the envelope is removed manually and placed in a receiving magazine.

An indexing apparatus for automatically effecting the envelope displacement operation has been developed.

The indexing apparatus according to the invention comprises:

a feed magazine for advancing a first envelope to the reading position;

a manual keyboard for producing the indexing program and transmitting it to a logic device;

an indexing station including a slot into which the envelope is introduced manually, this slot being defined at its lower part by a substantially horizontal belt moving towards a retractable arresting shutter against which the envelope drawn by the belt comes into abutment;

an indexing head as defined above, the indexing line of which occupies with respect to the belt and to the retractable shutter a position which corresponds to the position which the indexing marks will occupy with respect to the lower and forward parts of the envelope;

a device for advancing the envelopes from the indexing station to a receiving magazine.

BRIEF DESCRIPTION OF THE DRAWINGS

Other objects, features and advantages of the present invention will be made apparent from the following description of a preferred embodiment thereof provided with reference to the accompanying figures, in which.

DESCRIPTION OF PREFERRED EMBODIMENT

Figure 1:
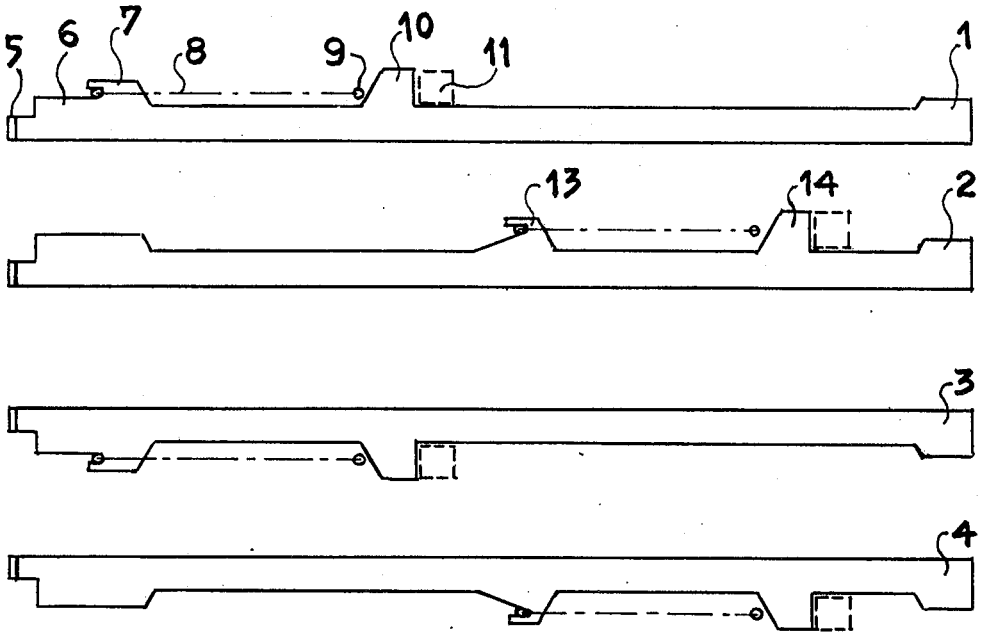
FIG. 1 shows a side view of the four types of reciprocal elements of the indexing head.

FIG. 1 shows the four arrangements of the reciprocal elements 1, 2, 3, 4.

These consist of metal plates about 1 mm in thickness and shaped as indicated in the figure. In the case of reciprocal element 1, the front end 5 is provided with substantially the dimensions of the indexing marks. A part 6 which is designed to be guided within an assembly which will be described hereinafter is terminated in a hook 7 in which the end of a polarizing spring 8 engages. This polarizing spring 8 is secured to a stationary point 9, thus tending to pull back the reciprocal element to the right as viewed in the drawing. A projection 10 rests against a stop element or a square 11 as will be described hereinafter. The rear end of the reciprocal element terminates in a part 12 designed to be guided in the slot of a comb positioned adjacent thereto. In the case of the reciprocal element 2, the hook 3 and the projection 14, corresponding respectively to the hook 7 and the projection 10 of the reciprocal element 1 are situated farther to the right, as viewed in the drawing on the rear part of the reciprocal element 2. The reciprocal elements 3 and 4 are exactly symmetrical to the reciprocal elements 1 and 2 with respect to a horizontal axis. When the reciprocal elements are placed in parallel with each other by means of front and rear combs which provide them with the desired spacing for the indexing marks, the similar adjacent parts 7 and 10 are separated by three spacings. This feature is used to provide each reciprocal element with a control signal by way of an electromagnet which is associated therewith.

Figure 2:
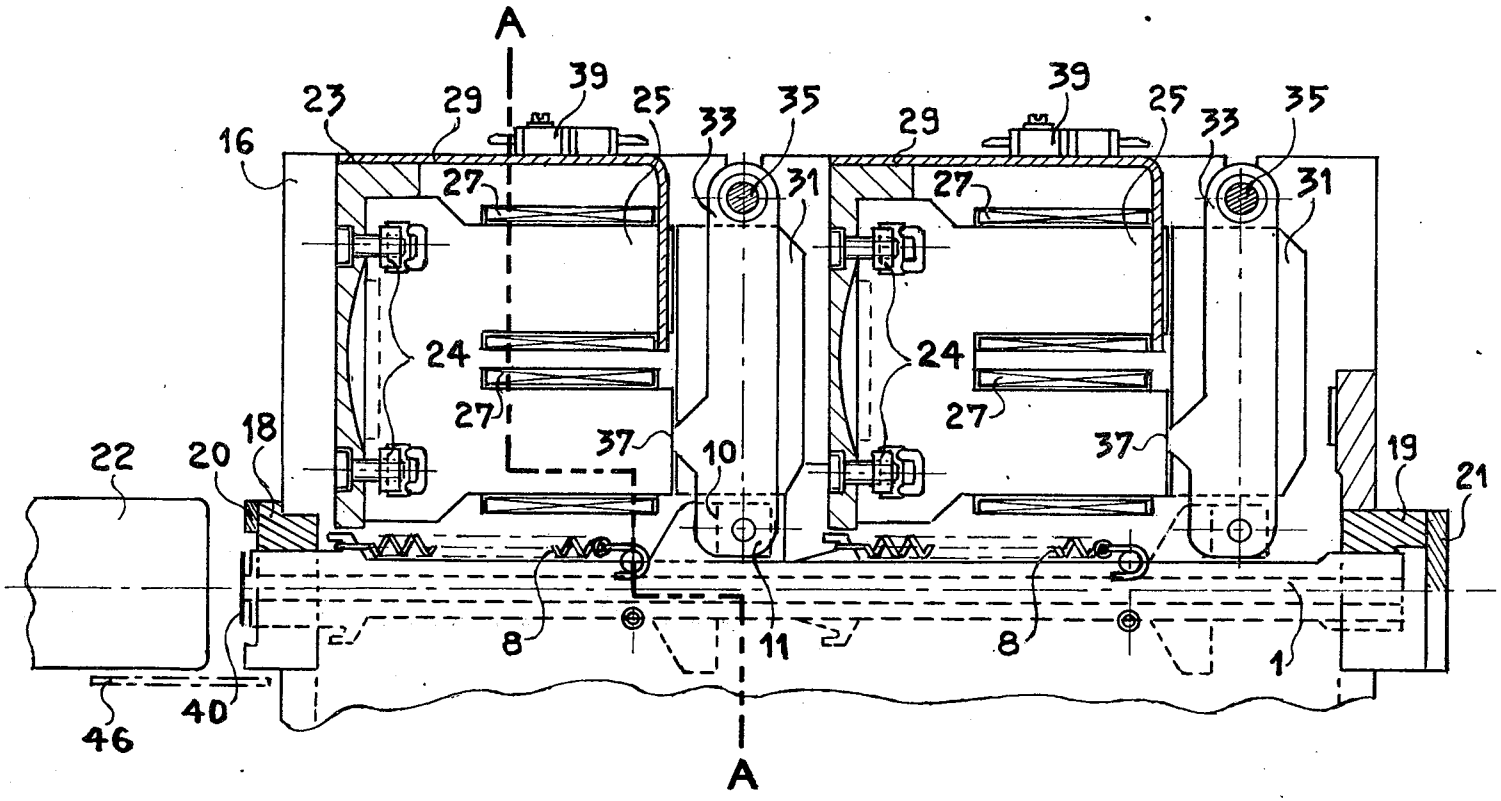
FIG. 2 shows a longitudinal vertical section respectively of an indexing head.

FIG. 2 shows a vertical sectional view of an indexing head passing through the plane of a reciprocal element. The lower part of the figure is not shown as it is exactly symmetrical with the upper part with respect to the horizontal axis.

Figure 3:
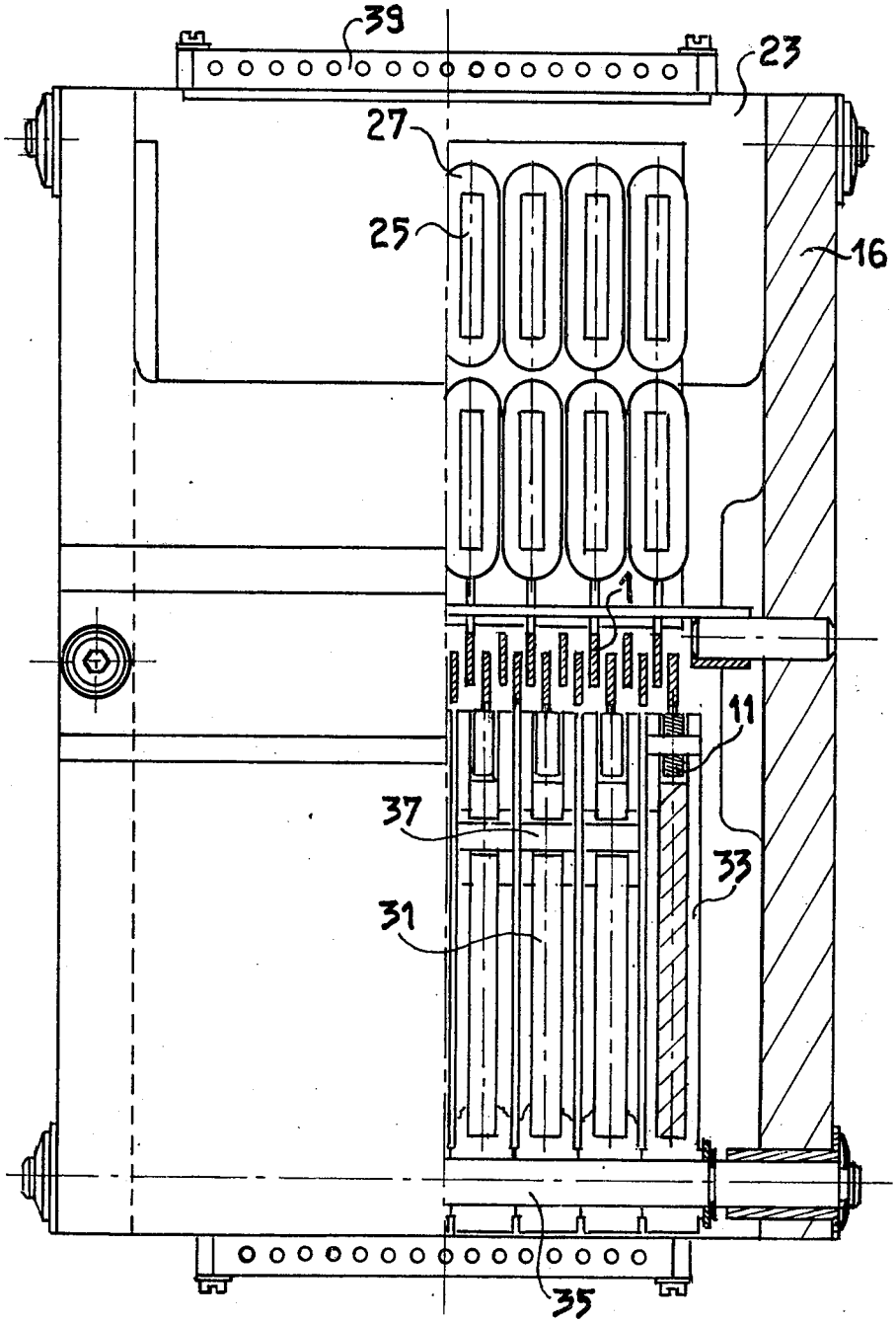
FIG. 3 shows a transversal vertical section along the line A—A of FIG. 2.

FIG. 3 shows a transversal vertical section along the line AA of FIG. 2.

Figure 4:
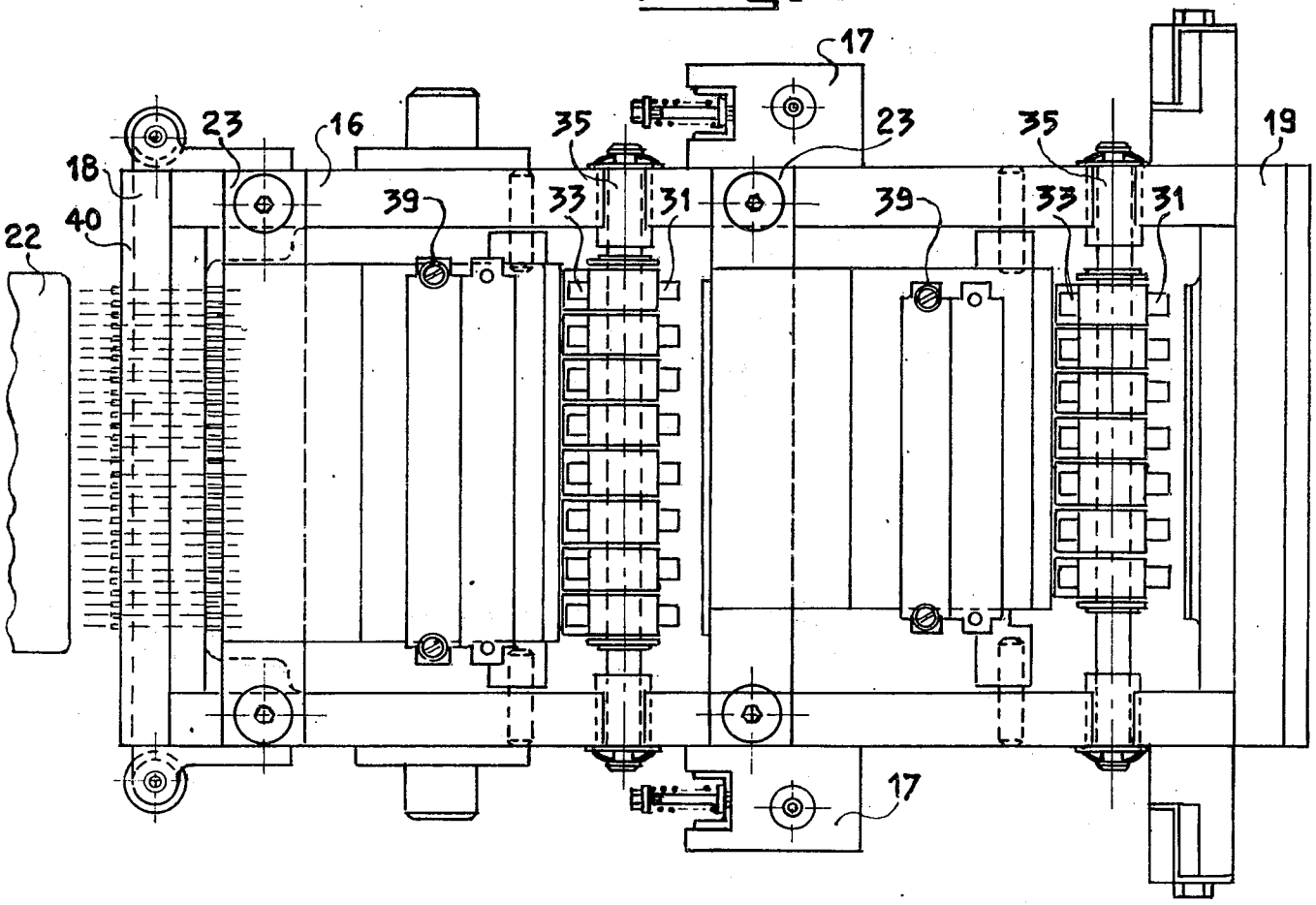
FIG. 4 shows a view from above of an indexing head.

FIG. 4 shows a view from above of the indexing head; only two connection arrangements of the electromagnets and the reciprocal elements (one at the front and the other at the rear) have been represented as all these connections are identical.

The indexing head comprises a frame 16 (See FIG. 2) attached by the flanges 17 to a framework which is not represented. On the front and rear faces, two combs 18 and 19 are used to guide the reciprocal elements 1, keeping them at the desired spacing. The reciprocal elements are shown in the printing or "out" positions. The combs are provided with abutments 20 and 21 for the core 22 of an electromagnet acting as an anvil for the printing operation and for the rear part of the reciprocal elements which are pulled back by their polarizing spring 8. The section of FIG. 2 is provided along the plane of the element 1. It is possible to note the hook 7 and the projection 10, the latter being in abutment with the square 11. The corresponding parts of the other reciprocal elements are represented merely by the dotted lines.

Four supports 23 (See FIGS. 2 and 4) are attached to the frame 16 (the two other supports which are not shown are symmetrically disposed on the lower part). The cores of the electromagnets 25 and 26 are secured by means of bolts 24 to the supports (two other cores which are not shown are secured in substantially the same plane in the lower part). These cores consist of a U-shaped soft iron plate about 2.5 mm in thickness. Windings 27 are wound on each of the arms of the core. These are held in place by stirrups 29 which are secured to the frame 16 and which extend on each side of the cores 25 and rest on the front of the windings as indicated in FIG. 2.

The mobile part of the electromagnets consists of a soft iron plate 31 secured to the inside of a support 33 made of plastic or other non-magnetic material. The support 33 is jointed at one end on an axis 35 secured to the frame 16 and at the other end is associated with the square 11 resting against the projection 10 of the reciprocal element 1 corresponding to the electromagnet 25. A projection 37 provided as shown on the support 33 is designed to rest against one arm of the core when the windings are excited so as to prevent the soft iron plate 31 from adhering to the core.

All the electromagnets are identical and they rest through the intermediary of stop elements or squares similar to the square 11 on the corresponding projections of the reciprocal elements with which they are associated.

It can easily be seen from FIG. 3 that the windings are practically contiguous and the space which they can occupy corresponds to the space separating four reciprocal elements. The reciprocal elements are about 1 mm in thickness and their pitch is 1.6 mm which provides for a possible thickness of the winding of about 6.5 mm. The thickness of the cores is about 2.5 mm. It is also possible to excite adjacent cores by induction by exciting a winding, the distance separating two adjacent windings being relatively small. It has also been possible to obtain correct operation of the indexing head by using the following standards:

return force of the polarizing springs 8, between 100 and 150 grams;

attractive force of the soft iron core 31, 1900 grams at the end of travel.

The windings have a power of 48 watts at 24 volts. Their feed wires are attached to bars 39.

The indexing code employed involves the printing of a plurality of marks by the reciprocal elements. In this case, the number is 20.

The total force of the 20 reciprocal elements as they are applied practically simultaneously to the envelope to be indexed can reach several tens of kilos and to prevent damage to the envelopes, it is necessary for these to be pressed on their opposite face to the reciprocal elements by an anvil means 22. The latter is rigidly connected to the core of an electromagnet and can be displaced when its winding is excited as far as an abutment 20 attached to the comb 18 (FIG. 2). The force of this electromagnet is about 6 kilos which is less than the total sum of the force applied by the reciprocal elements, but as will be indicated hereinafter, this force is graduated in time so as not to exceed the reaction force of the anvil at any given time. An inking ribbon 40 is moved slowly by means of a known mechanism, which is not represented, in front of the comb 18 defining the indexing line.

During operation, when the logic device has processed the indexing program, that is to say, has prepared the material to be supplied to the 20 windings corresponding to the indexing mark to be printed, and when the indexing head has obtained the printing signal, the electromagnet of the anvil 22 is first excited so that it presses against the envelope which is applied against the abutment 20. The different windings selectively chosen by the logic device then receive an impulse and by attracting the plates 31, they project the reciprocal elements 1 forwardly and these strike against the envelope through the intermediary of the inking ribbon 40. To reduce the shock which would be caused by the strictly simultaneous striking of the 20 indexing marks provided by the code, the windings are distributed in four groups receiving impulses seriatim and graduated by about 35 milliseconds.

Figure 5:
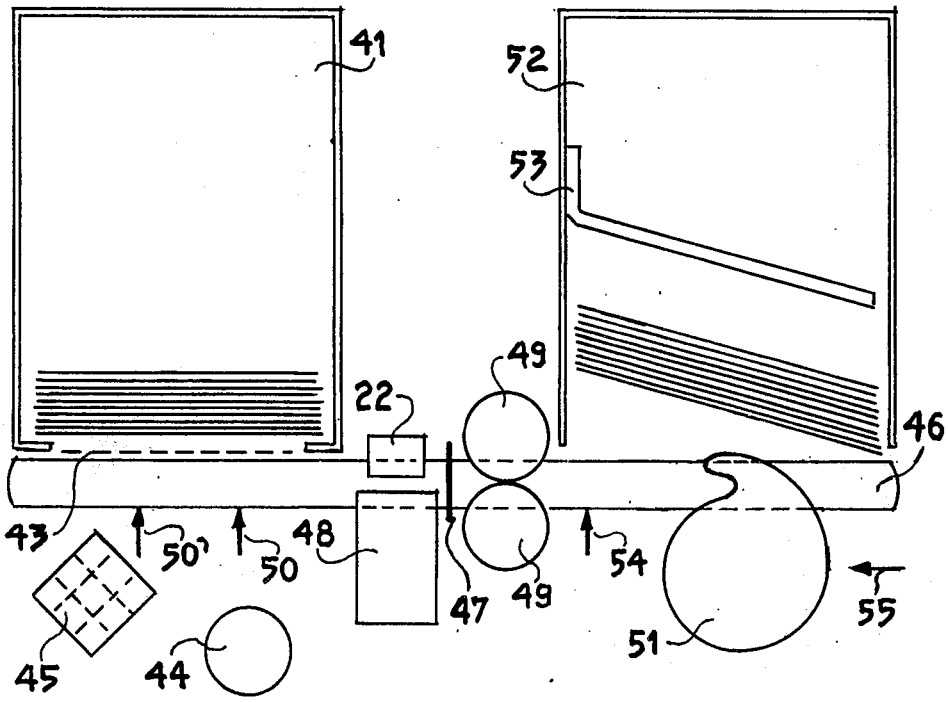
FIG. 5 shows a diagrammatic, plan view of an indexing apparatus.

FIG. 5 shows a diagrammatic plan view of an indexing apparatus designed to accommodate the indexing head described above.

This indexing apparatus consists of a feed magazine 41 having a known system (not represented) for applying the envelopes to be indexed against a display window 43 where an operator situated at 44 can read the address on the envelope and record on the keyboard 45 the signals translating the address which has been read.

After the reading operation, the operator manually lifts the envelope situated at the window 43 and drops it into a slot (not represented) which is closed at its upper part by the belt 46. Two photo-diodes 50 and 50' situated slightly above the belt are sensitive to the presence of an envelope. They each transmit a signal to the logic device so that the cycle commencing signal is only given when the two photo-diodes are acted on simultaneously, that is to say, when the envelope lies flat on the belt. Thus the arrangement of these two photo-diodes is a guarantee that the belt will not begin to move with an envelope which is not perfectly flat which would result in the envelope being incorrectly positioned in the indexing apparatus and consequently this would result in poor indexing.

A retractable shutter 47 arrests the envelope conveyed by the belt 46 to the right as viewed in the drawing in front of the indexing head 48 into a position which is such that the indexing strokes are effected in the desired position with respect to the front end and the base of the envelope. A pair of rollers 49, the axes of which are vertical, are situated immediately adjacent to the shutter 47. The belt extends to the right of the view of FIG. 5 as far as the end of the magazine 52. A feed system 51 known as a comma-type hook escapement is designed to rotate about a vertical axis and feed the envelopes into a receiving magazine 52 provided with an inclined polarizing blade 53.

Figure 6:
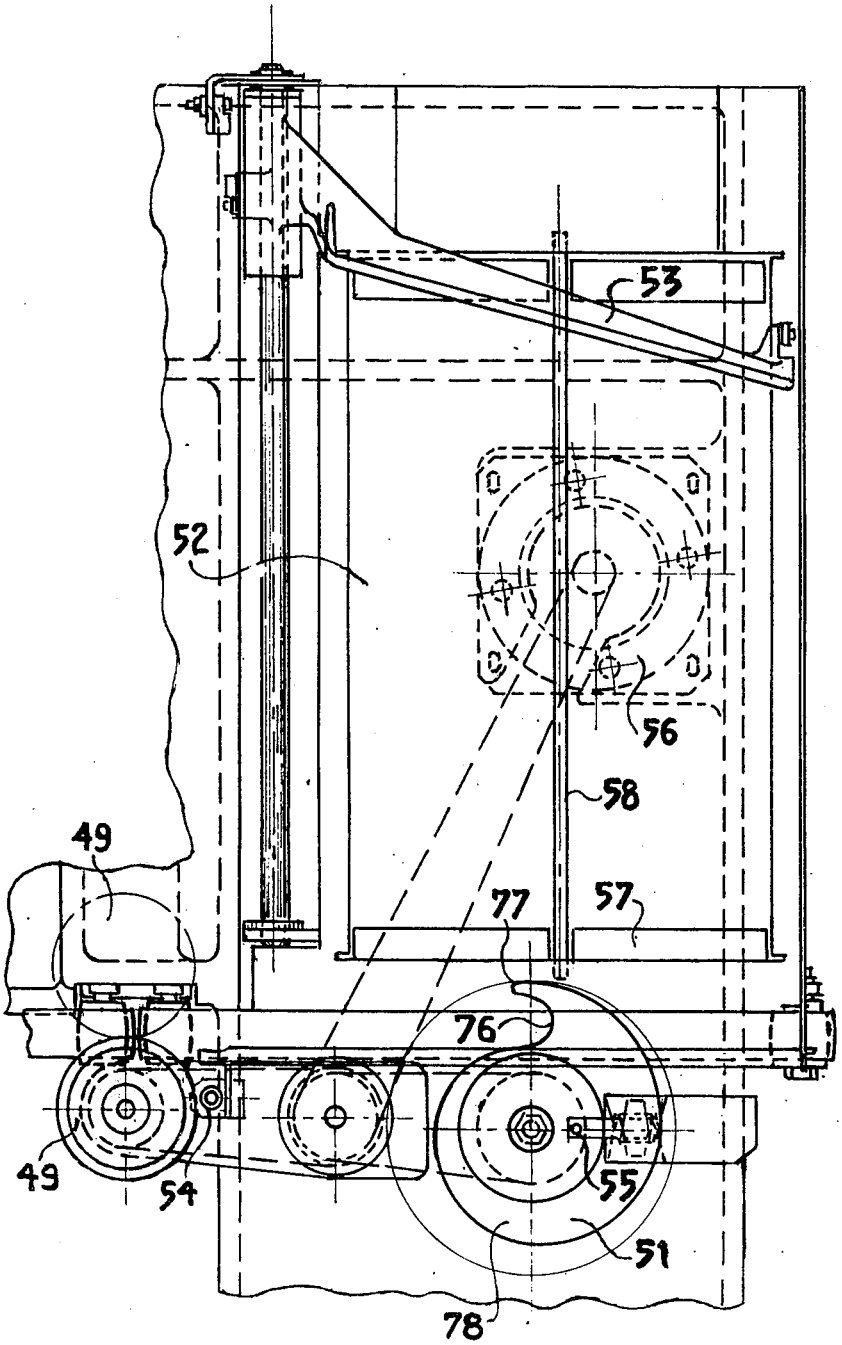
FIG. 6 shows a plan view of a part of an indexing apparatus showing details of the receiving magazine.

FIG. 6 shows a more detailed view of the escapement comma 51 and the magazine 52 with its blade 53. The escapement comma 51 is a spiral-form element which is represented in FIG. 6. It is characterized essentially by a spiral, the outer and inner arms of which are interconnected by an arc of a circle 76 defining a projection 77. The concavity of this arc 76 is rotated in the direction of the indexing position. In the rest position or normal position, the end of the spiral or the projection 77 of the escapement comma rests on the last of the envelopes stacked in the magazine which are pushed towards it by the blade 53. Rotation of the escapement comma 51 is controlled by way of the mechanism described hereinafter by means of two photo-diodes 54, 55. The pair of rollers 49 having vertical axes and the escapement comma 51 are driven in rotation by means of belts driven by a motor 56 situated below the magazine. The magazine 52 consists of a disc inclined at an angle of about 20° to the horizontal and provided over its length with loose-mounted transversal rollers 57. These rollers are in two parts and separated by a longitudinal part 58 such that the envelopes are completely unable to fall between the two rollers. The blade 53 which is inclined at an angle of about 20° over the normal with respect to the axis of the magazine is polarized by a system of counterweights which are not represented. This system exerts a constant force on the blade irrespective of its position. This force is about 1.5 kilos. The weight of the blade 53 is about 0.8 kilo.

Figure 7:
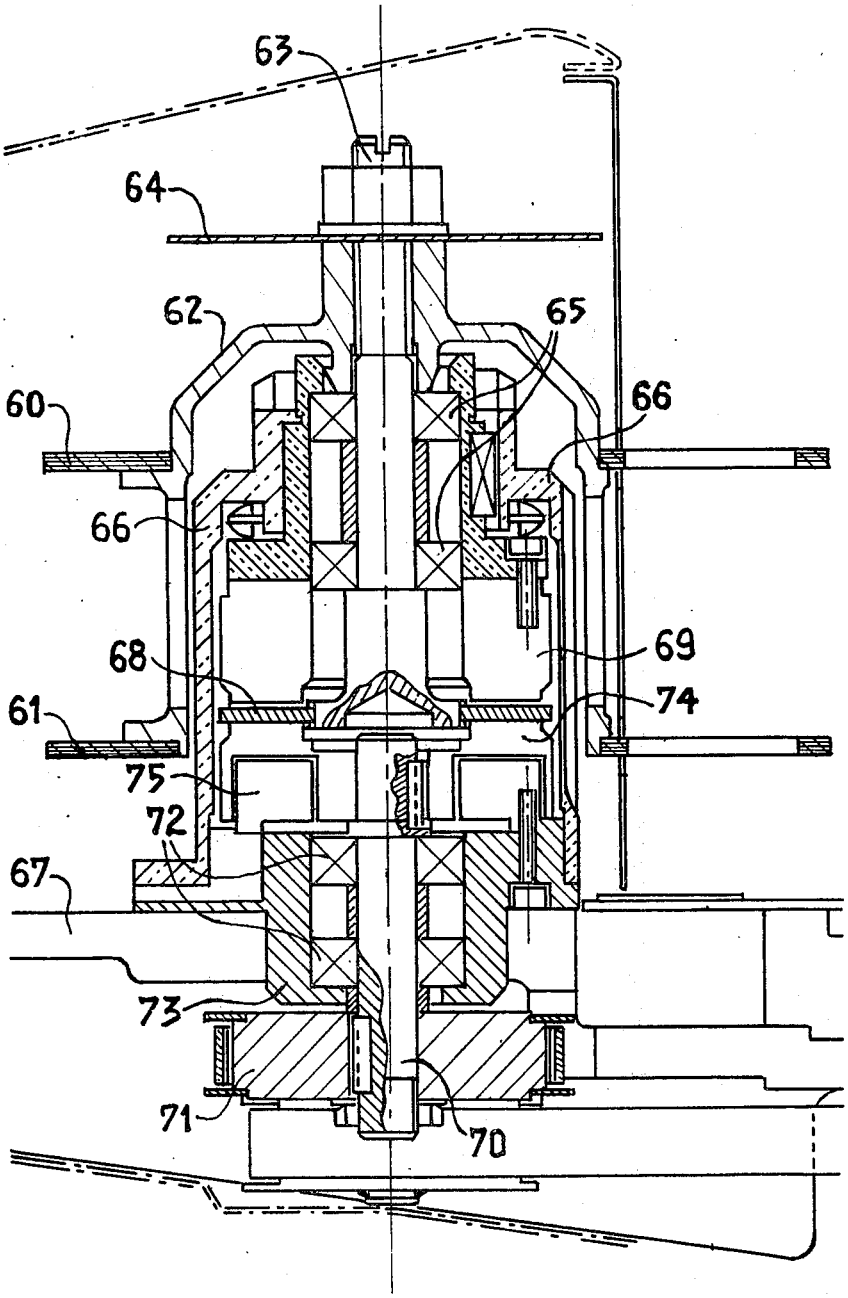
FIG. 7 shows a vertical section of a part of the receiving magazine showing details of a device for inserting the envelopes into the magazine.

The controlling of the movement of the escapement comma 51 is illustrated in the section represented in FIG. 7. The escapement comma comprises essentially two parallel discs 60 and 61 which are shaped as indicated in FIG. 6 and are attached to a cover 62 mounted on a shaft having an axis 63 together with a circular disc 64. The shaft 63 supported by two rollers 65 and secured inside the bore of another cover 66 concentric with cover 62 with the cover being secured to the frame 67. Beneath the shaft 63 and coaxial therewith, there is positioned a perforated flexible soft iron disc 68. Inside the stationary cover 66 is secured a winding 69 designed to draw the disc 68 against itself when it is excited and to rigidly connect the axis 63 of the fixed cover 66.

Coaxial with shaft 63 is a second shaft 70 supported by two rollers 72 driven by a belt passing over a pulley 71 said rollers being secured inside a bushing 73 integral with the cover 66 and consequently with the frame 67. A magnetic ring 74 inside which is located a winding 75 is fastened at the upper part of the shaft 70. The excitation of this winding 75 applies the flexible disc 68 against the ring 74 and thus rigidly connects the axes of the coaxial shafts 63 and 70.

During the indexing operations, the shaft 70 is driven in rotation by an electric motor which also drives the rollers 49. When the winding 69 is excited, the shaft 63 which is integral with respect to the escapement commas 50 and 51 is also at that time integral with the stationary cover 66 and thus immobile but it is immediately driven at the speed of the shaft 70 when the winding 75 is excited.

The escapement comma operates in the following manner to insert the envelopes into the receiving magazine.

The envelope which is held between the roller 49 after retraction of the shutter 47 is projected at great speed (about 4 m per second) towards the escapement comma. The photo-diode 54 which is acted on by the passage of the envelope triggers the feed to the winding 75 which causes the coupling of the escapement comma discs and causes them to turn at a rate which provides the semicircular part 76 of the discs with a similar speed to that of the envelope projected by the rollers 49. In the arresting position, the projection 77 of the escapement comma rests against the blade 53 (or on the last envelope in the pile pushed by the blade). As the escapement comma 51 rotates, the contact 77 slides on the blade 53 (or last envelope) and enables the same to be displaced under the effect of the polarizing force to which it is subjected, in a direction towards the outside of the magazine, that is, downwards in the FIG. 6. However, the movement of the escapement comma is sufficiently rapid compared to that of the blade 53 (and the stacked envelopes in abutment with this blade) for the blade or the last envelope not to have the time to come back into contact with the escapement comma 51 before the envelope projected by the rollers 49 in the concave part 76 has reached the storage position in the magazine.

This is made possible by the fact that the polarizing stress applied to the blade 53 is relatively low with respect to the weight of the same (about double) which accelerates the system and consequently provides the blade with a relatively low speed with respect to the speed of the projection 77.

The inclination of the blade over the normal with respect to the axis of the magazine also favors the spacing of this blade 53 or last envelope by the projection 77 and enables the envelope transported by the rollers 49 to cover its course before the blade 53 again encounters the projection 77 or the last envelope. Once a fresh envelope has been introduced in this way and has reached its storage position, it re-establishes contact with the inclined part of the spiral of the escapement comma at a point situated approximately at 78 opposite the projection 77 and it is repelled in the direction of the blade 53. The photo-diode 55 which is excited by a mark provided on the disc 64 causes the sharp arresting of the escapement comma 51 according to the process indicated above.

The general operation of the indexing apparatus has been described above. The sequential course of the operations in time is as follows:

It has been noted that the fall of an envelope coming from the feed magazine 41 caused the photo-diodes 50, 50' to transmit a signal to the logic device, that is when the envelope lies flat on the belt. The logic device comprises a timer which is triggered by this signal and which controls the sequence of indexing operations.

The timer starts to drive the belt 46 and the envelope comes into abutment against the retractable arresting shutter 47 which is in the arresting position. The envelope is then located in the indexing position. The timer then controls the starting of the motor 56 which drives the pair of rollers 49. The indexing head then receives the signal to excite the electromagnet of the anvil 22, and, thereafter at intervals of 35 thousandths of a second four printing signals for the four groups of electromagnets are selected according to the information provided in advance by the keyboard 45. The electromagnet of the anvil means is then isolated and the arresting shutter 47 is retracted. The envelope is then moved by the belt 46 towards the pair of rollers 49 which are already in motion and which project the envelope at great speed (about 4 meters per second) towards the concave part 76 of the comma 51. As it moves, the envelope acts on the photo-diode 54 which causes excitation of the winding 75 of the coupling of the comma 51 which is brusquely displaced. The position of the photo-diode is regulated in such a way that, given the speed of the envelope and the starting time of the escapement comma 51, the front part of the envelope is practically in contact with the arcuate recess 76. The photo-diode 55 acting on the winding 69 controls the arresting of the escapement comma 51 so that the concavity of the recess 76 is opposite the indexing position. During this time, the timer has controlled the closing of the retractable arresting shutter 47 and the stopping of the belt 46. The indexing apparatus is then in a position to receive another envelope.

What is claimed is:

1. An indexing head controlled by a logic device, to print indexing marks on a postal envelope along an indexing line, which comprises:

a plurality of reciprocal elements which are mounted in a receptacle so as to be parallel and longitudinally movable, the number of said elements being the same as the number of strokes which may be printed in the course of the indexing operation, the pitch of said elements being the same as the pitch of said strokes, a forward end of each element being situated along said indexing line and having the height and width of one of said strokes;

a plurality of identical electromagnets, the number of said electromagnets being the same as the number of said elements, each of said electromagnets being mechanically connected to one of said reciprocal elements which is associated therewith, and each of said electromagnets being excitable by an individual specific winding to exert a force upon its associated element for moving said associated element longitudinally forward until it strikes against said postal envelope through the intermediary of an inking ribbon;

said inking ribbon having a portion disposed along said indexing line between said postal envelope and the forward ends of said elements; and an assembly for receiving and holding immobile said envelope for the duration of the indexing operation, said assembly occupying with respect to said indexing line, a predetermined position with respect to the bottom and forward side of said envelope.

2. An indexing head as claimed in claim 1, wherein the mechanical connection points between said reciprocal elements and said electromagnets are staggered lengthwise from one element to another by a distance greater than the length of said electromagnets.

3. An indexing head as claimed in claim 1, further comprising anvil means which are displacable by means of an electromagnet to press the face of said envelope opposite said elements for the duration of the indexing operation.

4. An indexing head as claimed in claim 1, wherein the points of mechanical connection between said reciprocal elements and said electromagnets are staggered from one element to another alternately forwards and backwards and above and below in such a way that said electromagnets are distributed in four groups situated respectively on the front and rear, upper and lower parts of said reciprocal elements such that any two adjacent electromagnets are connected to reciprocal elements separated by three other elements.

5. An indexing head as claimed in claim 4, wherein said four groups of electromagnets are actuated simultaneously.

6. An indexing head as claimed in claim 4, wherein the excitation of said four groups of electromagnets is staggered in time.

* * * * *